US005957299A

United States Patent [19]

Keuschnigg et al.

[11] Patent Number: 5,957,299

[45] Date of Patent: Sep. 28, 1999

[54] SEPARATOR WHEEL FOR AN AIR SEPARATOR

[76] Inventors: Josef Keuschnigg, Lormanberg 67, A-8324 Kirchberg (Steiermark); Jurgen Roth, Schwarzenbachweg 6a, A-8773 Kammern, both of Austria

[21] Appl. No.: 08/889,577

[22] Filed: Jul. 8, 1997

[51] Int. Cl.[6] ..... B07B 4/00; B07B 7/04; B07B 7/00; B04B 5/12

[52] U.S. Cl. ..... 209/135; 209/137; 209/139.1; 209/714

[58] Field of Search ..... 209/135, 137, 209/139.1, 713, 714

[56] References Cited

U.S. PATENT DOCUMENTS

| | | | |
|---|---|---|---|
| 40,238 | 10/1863 | Broad | 209/139.1 |
| 2,367,906 | 1/1945 | Wall et al. | 209/714 |
| 3,767,045 | 10/1973 | Voelskow | 209/714 |
| 4,257,880 | 3/1981 | Jones | 209/714 |
| 4,689,141 | 8/1987 | Folsberg . | |
| 4,776,950 | 10/1988 | Green et al. | 209/714 |
| 4,799,595 | 1/1989 | Binder | 209/135 |
| 4,871,104 | 10/1989 | Cassese . | |
| 4,934,900 | 6/1990 | Schonbach et al. . | |
| 5,301,812 | 4/1994 | Garrett et al. | 209/714 |

FOREIGN PATENT DOCUMENTS

| | | | |
|---|---|---|---|
| 0 244 744 | 11/1987 | European Pat. Off. . | |
| 0 457 751 | 11/1991 | European Pat. Off. . | |
| 0 477 163 | 3/1992 | European Pat. Off. . | |
| 0 552 837 | 7/1993 | European Pat. Off. . | |
| 0 564 758 | 10/1993 | European Pat. Off. . | |
| 0 603 151 | 6/1994 | European Pat. Off. . | |
| 2 574 392 | 6/1986 | France . | |
| 2 623 427 | 5/1989 | France . | |
| 816941 | 7/1949 | Germany | 209/135 |
| 2613611 | 10/1977 | Germany | 209/137 |
| 5-68904 | 3/1993 | Japan . | |
| 7-112161 | 5/1995 | Japan . | |
| WO 95/07149 | 3/1995 | WIPO . | |
| WO 95/07150 | 3/1995 | WIPO . | |

*Primary Examiner*—William E. Terrell
*Assistant Examiner*—Joe Dillon, Jr.
*Attorney, Agent, or Firm*—Young & Thompson

[57] ABSTRACT

A separator wheel for an air separator, through which separation air loaded with fine material flows through the separator wheel from the outside to the inside and in which the separation air loaded with fine material is discharged in an axial direction from separator wheel, includes at its periphery channels in axially different radial planes with different angles to the radial direction of the separator wheel, the angle of incline of the channels near an outflow end of the separator wheel being greater than the angle of incline of channels away from outflow end.

20 Claims, 4 Drawing Sheets

SEPARATOR WHEEL FOR AN AIR SEPARATOR

BACKGROUND OF THE INVENTION

The invention relates to a separator wheel for an air separator which on its periphery has channels, through which separation air loaded with fine material flows through the separator wheel from the outside to the inside and in which the separation air loaded with fine material is discharged in the axial direction from the separator wheel.

DESCRIPTION OF THE RELATED ART

Separators are designed to separate the separation material into fine material and coarse material; this can be done for example as described in EP-A1 552 837 by flow taking place through the separator wheel of an air separator roughly radially from the outside to the inside, after which the separation air loaded with fine material is discharged in the axial direction from the separator wheel. The rotation of the separator wheel and the resulting centrifugal forces in the channels or in the area of the outer ports of the channels accelerate the coarse material to the outside and it cannot be discharged to the inside with the separation air and the fine material.

Thus the problem arises that due to the higher flow velocities or greater pressure difference in the area of the axial outflow end of the separator wheel, more coarser separation material is removed at the same time than in the middle area of the separator wheel or its area away from the outflow end, so that separation or classification of the separation material into coarse material and fine material does not often take place as exactly as desired.

Here it can be stated that on the axial ends of the separator wheel, due to the edge flow, much larger particles are entrained than is the case in the middle of the separator wheel. In interaction with the separator housing therefore backflows also occur which cause undefined separation as a result. If the practical results are compared to the theoretical calculations after Stokes, it can be easily recognized that in practice the largest particles in the fine material are larger by several fold than under ideal conditions, science itself however having proven that particle sedimentation after Stokes takes place.

To solve this problem, in EP-A1 552 837 it was suggested that within the separator wheel a distributor tube be placed in which there is a plurality of openings, the size of the openings increasing more and more away from the axial outflow end of the separator wheel. Due to the smaller openings near the outflow end the flow resistance is higher than in the area away from the outflow end, so that in this way more constant behavior of the flow velocity or the acting underpressure is achieved within the separator wheel over its axial length.

However, the solution suggested in EP-A1 552 837 has the disadvantage that power consumption of the separator is increased by the openings in the distributor tube which act as chokes; this is especially disadvantageous at high flow velocities. On the other hand, the larger particles should be repelled upon entry into the channels on the periphery of the separator wheel; this is not done in this approach.

SUMMARY OF THE INVENTION

Therefore the object of the invention is to make available a separator wheel of the initially mentioned type with which separation behavior as constant as possible can be achieved over the axial length of the separator wheel.

This object is achieved in a separator wheel of the generic type by the channels in axially different radial planes having different angles to the radial direction of the separator wheel.

The varied angular incline of the channels in the axially different radial planes on the outside periphery influences the repulsion of the stream of particles from the separation air over the axial length of the separator wheel to varying degrees.

Repulsion on the outside radius of the rotor very effectively influences not only the separation air, but also the particles. In order to appropriately take into account the flow behavior which is three-dimensionally very different or in those areas along the rotor where mainly overly large particles pass, to prevent this, it is advantageous to influence to varying degrees the repulsion in axially different radial planes by channels with different angles to the radial direction of the separator wheel.

Thus the invention utilizes the circumstance that the incident flow of separation air which is loaded with fine material toward the outer port of the channels is influenced by the slope of the channels to the radial direction of the separator wheel. If therefore the channels are aligned in axially different radial planes at different angles to the radial direction of the separator wheel, the aforementioned more uniform separation properties can be achieved by the separator wheel without the need for additional means, such as a distributor tube according to EP-A1 552 837, which cause choke losses or high pressure losses.

In particular, in one preferred embodiment of the invention which is characterized in that the channels are sloped from the inside to the outside against the direction of rotation, it is proposed according to the invention that the angle of incline of the channels on the outflow end of the separator wheel is larger than the angle of incline of the channels away from the outflow end. With this embodiment very good separation behavior of the separator can be achieved, since the aforementioned repulsion property acts not only on the separation air, but also on the particles to be separated.

Other preferred embodiments of the invention are the subject of the other subclaims.

In the following preferred embodiments of the invention are described with reference to the drawings.

DESCRIPTION OF THE PREFERRED EMBODIMENTS

Figure 1:
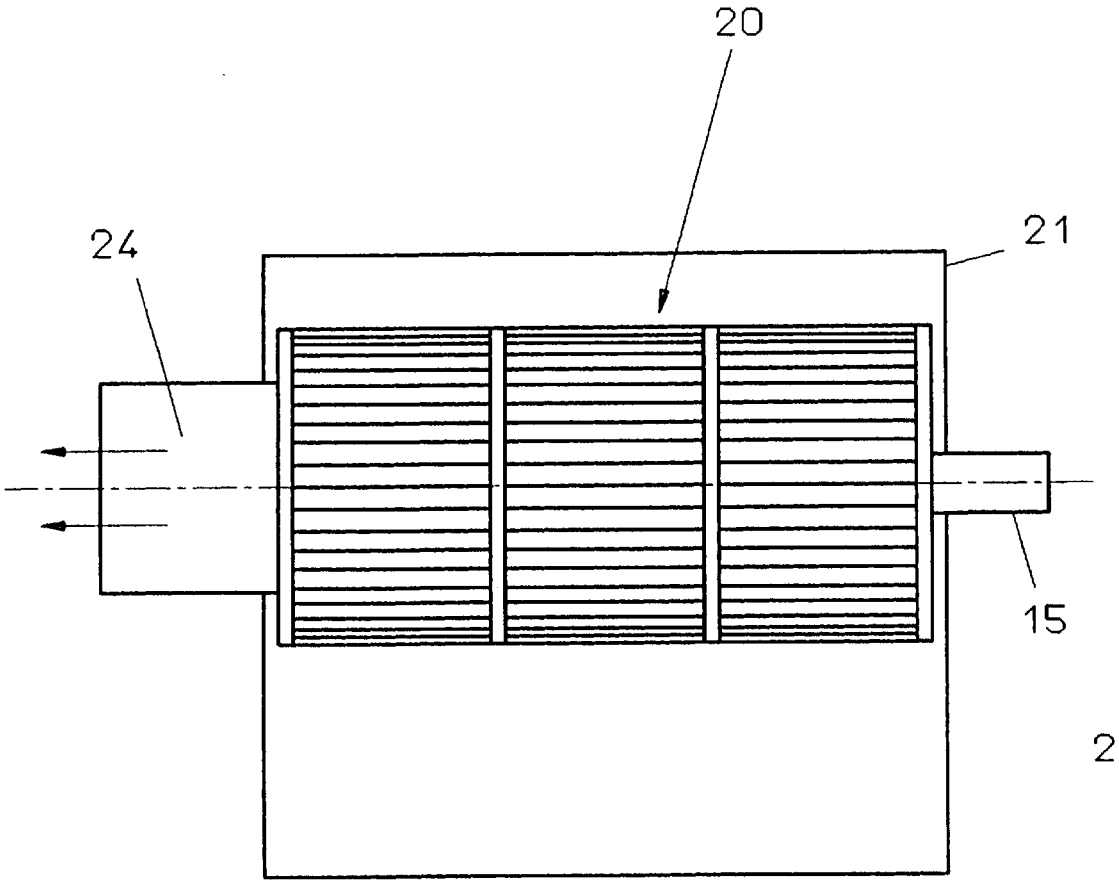
FIG. 1 schematically shows an air separator with three segments in a longitudinal section.

FIG. 1 schematically shows an air separator with separation wheel (rotor) 20 according to the invention, separator wheel 20 being accommodated in housing 21 with inlet 23 for separation air with the separation material and outlet 22 for coarse material. The separation air with the separation material is discharged through axial outlet 24.

Figure 2:
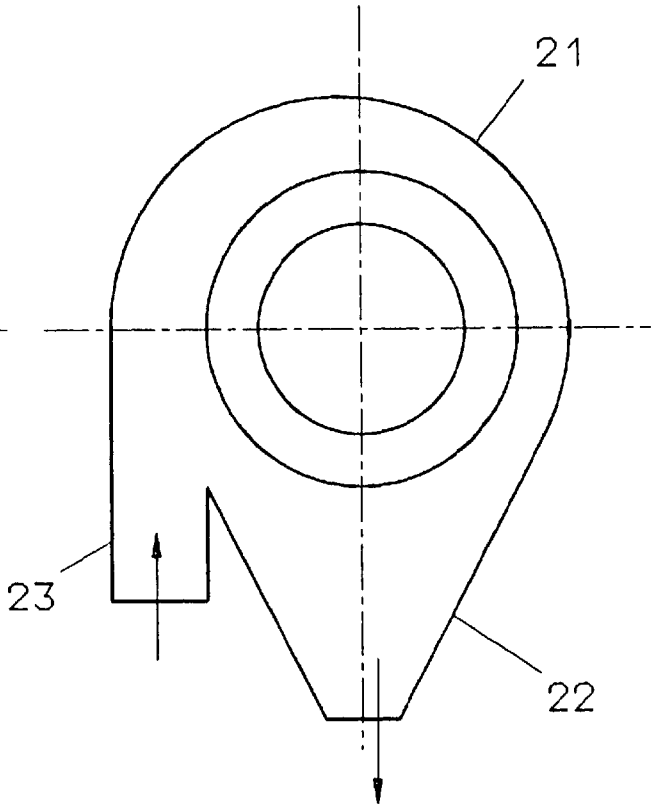
FIG. 2 shows a view of the air separator from FIG. 1 from the left.

It goes without saying that instead of housing 21 shown and described in FIGS. 1 and 2, other forms of housings can also be used, and that the separation air and separation material can also be supplied to housing 21 separately from one another.

Figure 3:
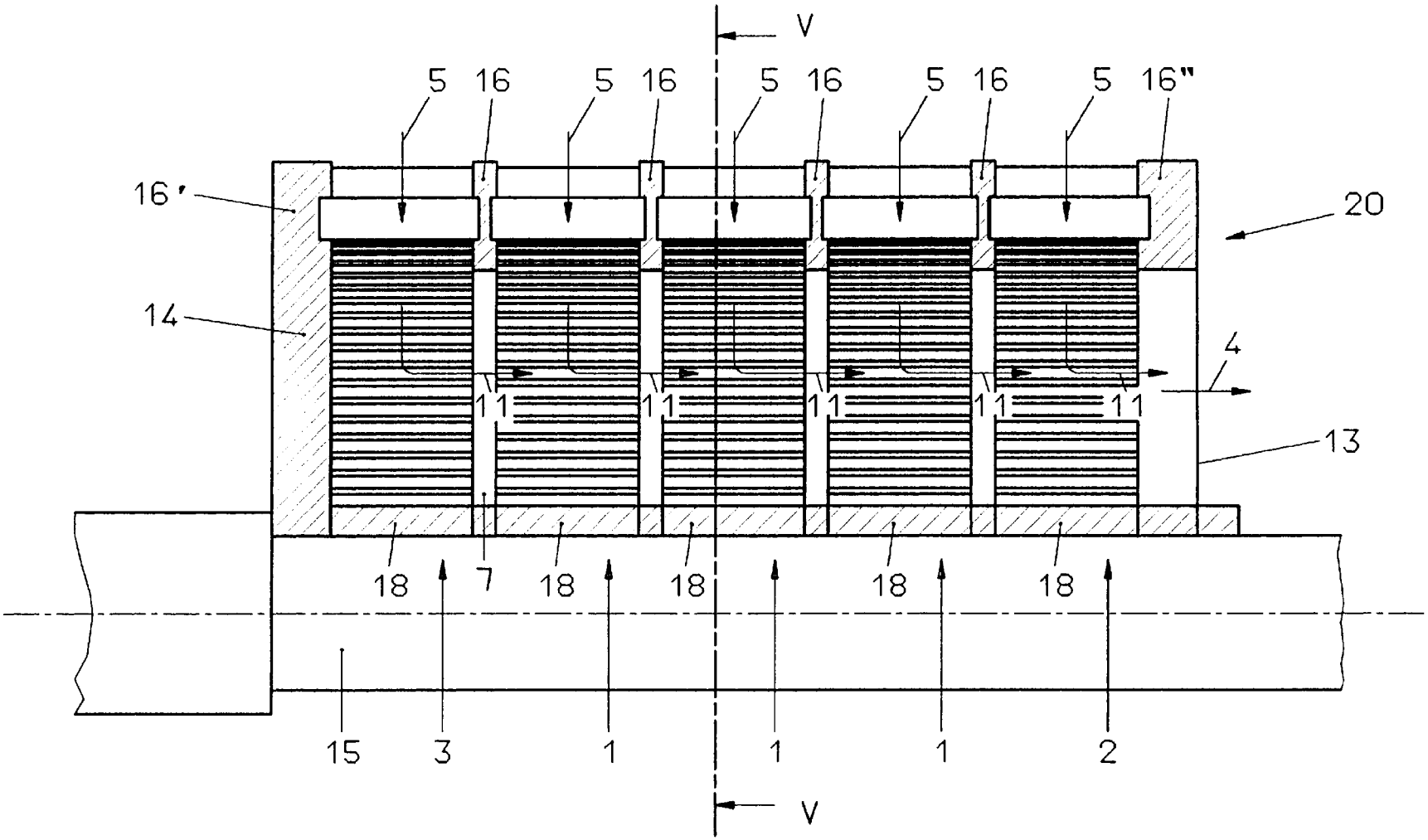
FIG. 3 shows a partial view of a separator wheel according to the invention with five segments in a section.

FIG. 3 shows separator wheel 20 according to the invention partially in cross section; it is composed of five separator wheel segments 1, 2 and 3. Separation air with separation material is supplied to separation wheel 20 in the direction of arrows 5 and separation air which is loaded with fine material is discharged from the separator wheel at outflow end 13 in the direction of arrow 4 through outlet 24.

Figure 4A:
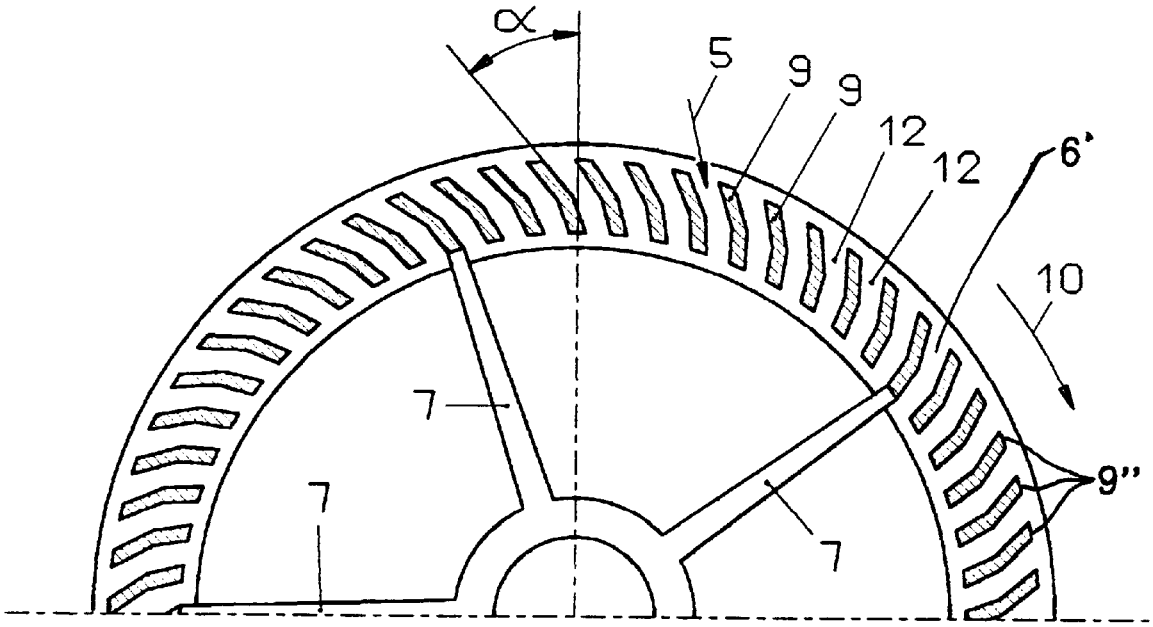
FIGS. 4A and 4B show an axial view of first embodiments of a separator wheel segment.
Figure 4B:
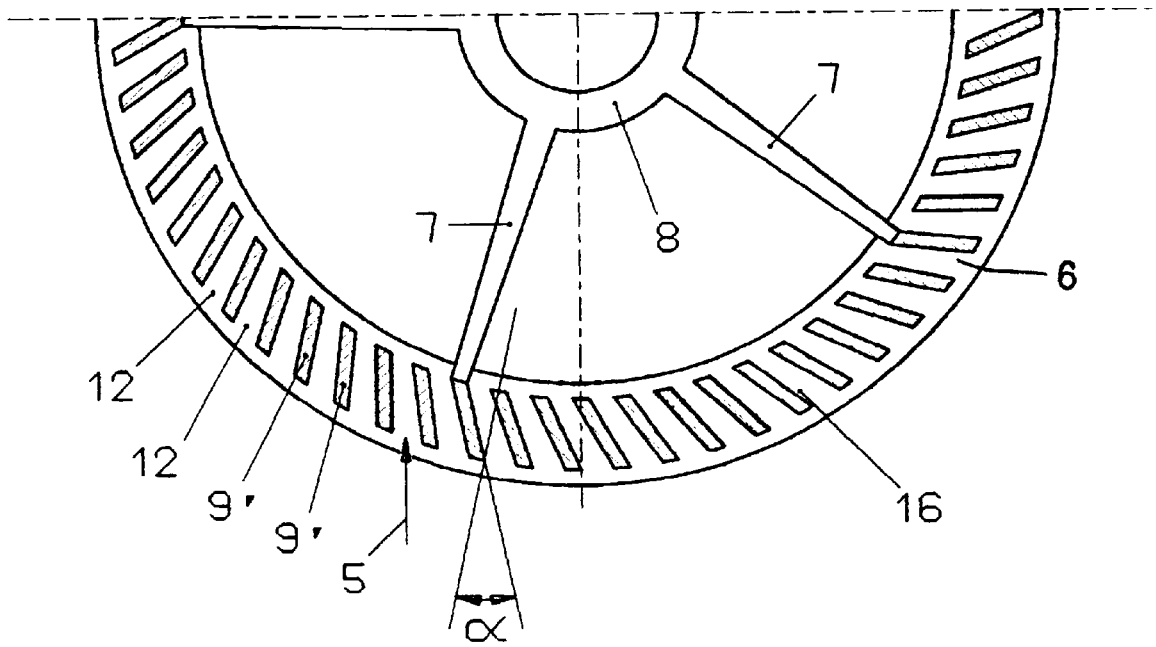

In first embodiments shown in an axial view in FIGS. 4A and 4B separator wheel segments 1 and 2 consist of carriers 6, 6' which are joined to hub 8 via five spokes 7. On carriers 6, 6' are a plurality of wheel blades 9, 9' which extend in the axial direction of separator wheel segment 1, 1'. Wheel blades 9, 9' can be bent in the radial direction of separator wheel segment 1, 1', as is shown using wheel blades 9, or can be curved as shown by blades 9". The wheel blades can however also be made in their simplest form as flat rotor bars, as is shown using wheel blades 9' in FIG. 4B. In their external area wheel blades 9, 9' have an angle of incline $\alpha$ to the radial. The angle of incline $\alpha$ in the outer region determines the separation behavior more dramatically than the angle of incline in the inner region of channels 12 for wheel blades 9.

Wheel blades 9, 9' are sloped at angle $\alpha$ to the radial such that they are sloped from the inside to the outside opposite direction of rotation 10 of separator wheel 20. This slope makes it more difficult for coarser particles of the separated material to flow through separator wheel 20 in the direction of arrow 5 from the outside to the inside, so that good separation of the separated material is possible.

After the separation air with the fine material passes through channels 12 formed between wheel blades 9, 9' from the outside to the inside, the separation air loaded with fine material is deflected by 90 degrees and flows in the axial direction of the separator, as is illustrated by arrows 11 in FIG. 3.

Separator wheel segment 3 in FIG. 3 differs in the embodiments in FIGS. 4A and 4B from separator wheel segments 1, 2, etc. in that carrier 6 is not joined to hub 8 via spokes, but via continuous disk 14, as can be seen in FIG. 3. This is necessary since separator wheel segment 3 is located on the end opposite outflow end 13 of the separator wheel and thus forms the termination of the separator wheel.

Angle of incline $\alpha$ of separator wheel segments 1, 2 and 3 is greater in separator wheel segments 2 and 3 than in separator wheel segment 1. The greater angle of incline of wheel blades 9, 9' or channels 12 formed between them increases repulsion for the separation air particle flow so that here passage of larger particles is prevented and thus improved separation behavior of the entire rotor for more accurate separation is achieved.

Figure 5A:
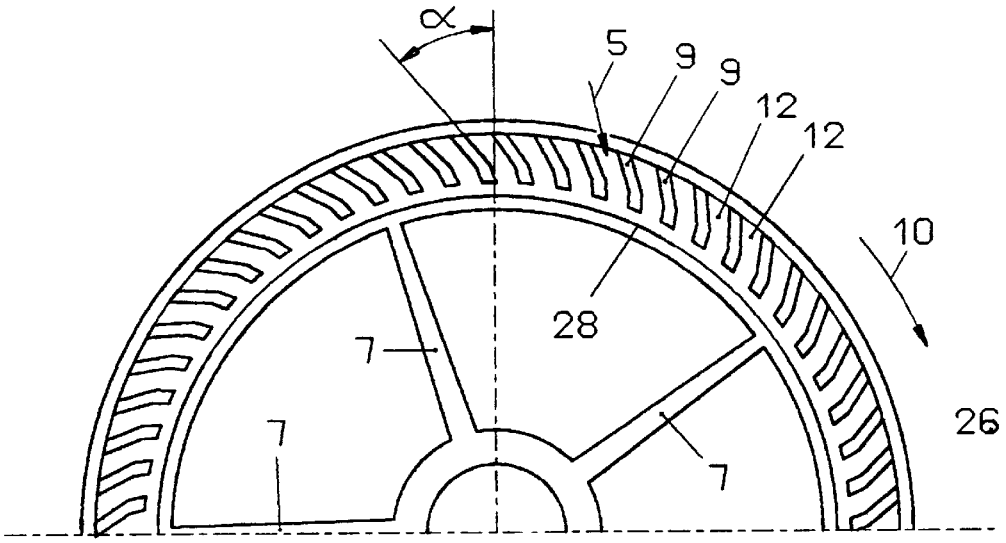
FIGS. 5A and 5B show an axial view of second embodiments of a separator wheel segment.
Figure 5B:
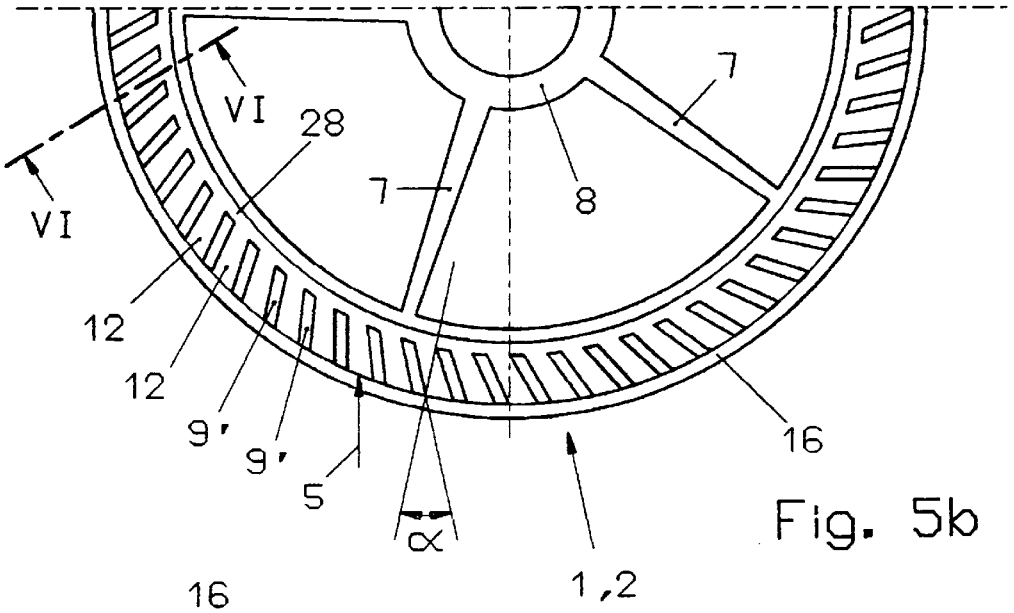
Figure 6:
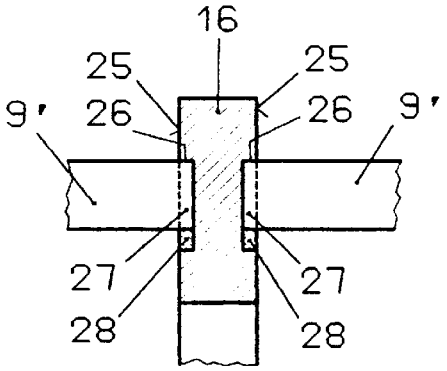
FIG. 6 shows a section through one part of the separator wheel segment from FIG. 5B along line VI—VI.

It is stated that the separator wheel segments shown in FIGS. 4A and 4B do not coincide exactly with the separator wheel segments shown in FIG. 3 since the separator wheel segments shown in FIGS. 4A and 4B are an integral part in which blades 9, 9' are molded on carrier 6, conversely the separator wheel segments shown in FIG. 3 are those in which blades 9, 9' are held by form-fit between support disks 16, 16', 16", as can be seen in detail in FIGS. 5A, 5B and 6.

Middle support disks 16 for this reason on their two faces 25 have peripheral grooves 26 which hold blades 9, 9' with their end 27. To fix blades 9, 9' in their position on support disks 16, there are spacers 28 which overall have an annular shape and which are inserted into groove 26 on either side of support disk 16. To hold ends 27 of blades 9, 9' spacers 28 have slots which are radically (sloped by angle of incline 60 to the radial) open to the outside and in which blades 9, 9' lie.

Edge-side support disks 16', 16" have a design similar to middle support disks 16, here there being one groove 26 for holding blades 9, 9' on the face towards the interior of separator wheel 20.

The above described structure of separator wheel 20 of support disk 16, 16', 16", between which blades 9, 9' are held by form-fit without penetrating them, has the advantage that the structure of separator wheel 20 is very stable throughout, since support disks 16 have high carrying capacity due to their continuous annular cross section. It goes without saying that this structure of a separator wheel of support disks and blades held by form-fit in between can also be used in separator wheels in which the channels between the blades have an essentially identical alignment over the entire length of the separator wheel.

As can be further seen in FIGS. 1 and 3, separator wheel segments 1, 2 and 3 are seated torsionally strong on shaft 15 via which separator wheel segments 1, 2 and 3 are driving using a drive not shown.

The angle of incline of channels 12 formed between wheel blades 9, 9' is preferably between 30 and 45 degrees, but depending on the respective conditions, such as the particle size or the specific weight of the particles of the separation material or on the desired fractional ratio between coarse and fine material, it can also be above or below, for example between 15 and 60 degrees.

In alternative embodiments not shown in the drawings it is also possible that instead of channels 12 formed between wheel blades 9, 9' there are openings, for example, holes, or that the separator wheel is not composed of individual segments which contain the channels, but that channels with different angles of incline in different radial planes are located in an integral separator wheel or in a single separator wheel segment.

In another embodiment not shown in the drawings either, the separation air loaded with fine material can also be discharged on the two axial ends of the separator wheel via outflow channels in order to increase the efficiency of the separator according to the invention.

We claim:

1. Separator wheel for an air separator comprising: a rotor with a cylindrical periphery with a constant outside radius, which on said periphery has channels through which separation air loaded with fine material flows through said rotor from the outside to the inside and in which the separation air loaded with fine material is discharged in the axial direction from said rotor, wherein said channels in axially different radial planes have different angles of incline to the radial direction of said rotor on said outside radius of said rotor.

2. Separator wheel according to claim 1, wherein said channels are formed by openings in a jacket surface of the separator wheel.

3. Separator wheel according to claim 1, wherein the separator wheel further comprises first and second separator wheel segments, each of said first and second separator wheel segments comprising said channels, said channels of said first separator wheel segment being aligned at a different angle to the radial direction than said channels of said second separator wheel segment.

4. Separator wheel according to claim 1, wherein the angle of incline of said channels to the radical direction changes from the outside to the inside.

5. Separator wheel according to claim 1, wherein said channels are sloped from the inside to the outside opposite a direction of rotation of said rotor.

6. Separator wheel according to claim 1, wherein the angle of incline of said channels is roughly between 15 and 60 degrees to the radial direction.

7. Separator wheel according to claim 1, wherein the angle of incline of said channels near an outflow end of the separator wheel is greater than the angle of incline of said channels away from said outflow end.

8. Separator wheel according to claim 1, further comprising two outflow channels which adjoin the separator wheel axially on opposite sides and through which the separator air loaded with fine material is discharged.

9. Separator wheel according to claim 1, wherein the angle of incline of said channels is roughly between 30 and 45 degrees to the radial direction.

10. Separator wheel according to claim 1, wherein channels are bounded by essentially axially aligned wheel blades.

11. Separator wheel according to claim 10 said wheel blades are curved.

12. Separator wheel according to claim 3, wherein said first and second separator wheel segments further comprise an annular disk-shaped carrier to which separator wheel blades are molded projecting in the axial direction.

13. Separator wheel according to claim 10, further comprising radially extending support disks between which said wheel blades are held by form-fit.

14. Separator wheel according to claim 13, wherein said wheel blades avoid direct contact with said support disks.

15. Separator wheel according to claim 13, wherein the area of the outer edges of said support disks comprises faces with recesses which hold ends of said wheel blades.

16. Separator wheel according to claim 15, wherein said recesses are annular grooves and wherein said wheel blades are fixed in position in said annular grooves by spacers.

17. A separator wheel for an air separator comprising a generally cylindrical body having plural channel sets with the same outside radius, each channel set being arranged in an axially different radial plane, each channel set comprising an angle of inclination profile with respect to the radial direction of said wheel, wherein a first of said plural channel sets comprises a first angle of inclination profile different from a second of said plural channel sets.

18. The separator wheel of claim 17, wherein said plural channel sets further comprise straight wheel blades and said first angle of inclination profile consists of a single angle of inclination with respect to the radial direction of said wheel.

19. The separator wheel of claim 17, wherein said plural channel sets further comprise bent wheel blades, said bent wheel blades comprising first and second straight segments, and said first angle of inclination profile comprises a first angle of inclination with respect to the radial direction of said wheel defined by said first straight segment and second angle of inclination with respect to the radial direction of said wheel defined by said second straight segment.

20. The separator wheel of claim 17, wherein said plural channel sets further comprise curved wheel blades, said curved wheel blades comprising points along a curved surface of said curved wheel blades, and said first angle of inclination profile comprises angles of inclination with respect to the radial direction of said wheel defined by said points.

* * * * *